US006396370B2

(12) United States Patent
Leone et al.

(10) Patent No.: US 6,396,370 B2
(45) Date of Patent: May 28, 2002

(54) BI-METAL TRIP UNIT FOR A MOLDED CASE CIRCUIT BREAKER

(75) Inventors: David A. Leone, Lilburn; James E. Ferree, Lawrenceville; Bernard DiMarco, Lilburn, all of GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/738,809

(22) Filed: Dec. 15, 2000

Related U.S. Application Data

(62) Division of application No. 09/434,233, filed on Nov. 5, 1999, now Pat. No. 6,181,226.

(51) Int. Cl.[7] ..... H01H 81/00; H01H 83/00
(52) U.S. Cl. ..... 335/35; 335/202; 335/172
(58) Field of Search ..... 335/23–25, 35–38, 335/42–45, 167–176, 202

(56) References Cited

U.S. PATENT DOCUMENTS 2,884,497 A * 4/1959 Steven et al. ..... 335/35
4,719,438 A * 1/1988 Mrenna et al. ..... 335/35
5,608,367 A * 3/1997 Zoller et al. ..... 335/132

* cited by examiner

*Primary Examiner*—Lincoln Donovan

(57) ABSTRACT

The circuit breaker (10) of the present invention is a molded case circuit breaker and includes a molded case (12) having a main cover (20), a first terminal (16) and a second terminal (16) mounted inside the case (12) with a stationary contact (44) electrically coupled to the first terminal (18) and a movable contact (42) electrically coupled to the second terminal (16). The movable contact (42) is coupled to an operating mechanism (40) which has a pivoting member (13) moveable between an ON position, an OFF position and a TRIPPED position. An intermediate latching mechanism (52) also is mounted in the housing (12) and is coupled to the operating mechanism (40). The intermediate latching mechanism (52) is selectively operated by a trip unit (60) which comprises a magnetic short circuit release and a thermal overload release. The trip unit (60) can be reconfigured by the addition of an inner yoke (67) nested between the flanges (71) of an outer yoke (66) and a second magnetic shield (70) can be attached to the outer yoke (66) to change the sensitivity of the trip unit (60) to the currents experienced by the circuit breaker. A particular embodiment of the circuit breaker (10) includes an interchangeable bi-metal (62) member of a copper alloy having a chemical composition of CDA #19400 and with an electrical conductivity of not more than 40% IACS.

9 Claims, 6 Drawing Sheets

BI-METAL TRIP UNIT FOR A MOLDED CASE CIRCUIT BREAKER

This is a division of Application Ser. No. 06/434,233 filed Nov. 5, 1999, now Pat. No. 6,181,226, issued Jan. 30, 2001, and titled BI-METAL TRIP UNIT FOR A MOLDED CASE CIRCUIT BREAKER.

FIELD OF THE INVENTION

The present invention relates generally to the field of circuit breakers, and more particularly to a molded case circuit breaker bi-metal trip unit capable of broad rating applications.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as 160 amps. The tripping mechanism for the breaker usually consists of a thermal overload release and a magnetic short circuit release. The thermal overload release operates by means of a bi-metalic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that current is flowing. For a given range of current ratings, the bi-metal cross-section and related elements are specifically selected for such current range resulting in a number of different circuit breakers for each current range.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker. The prior art provides several methods to tune the magnetic trip unit for different trip currents. First, the armature spring force can be varied, by an adjustment or by changing springs, to change the resisting force on the armature, which changes the current required to trip the breaker. Second, the cross section of the steel in either the yoke, armature or both can be adjusted to increase or decrease the amount of magnetic flux created by the short circuit current. One approach to resolving these issues, is to vary the material thickness, i.e., steel cross section of the magnetic trip elements. However, if the magnetic yoke is made thicker for all ratings, then this reduces the space available inside the magnetic yoke. Reduced space means less cross sectional area available for carrying current in the conductors and also less room for making calibration adjustments. Changing the steel thickness also has the disadvantage of changing the features which mount the yoke and armature in the breaker and thus common mount features cannot be used.

Thus, there is a need for a molded case circuit breaker capable of a broad rating application with a system of parts that works throughout a broad range of current ratings, with a minimum of unique parts and manufacturing tools. Further there is a need for a molded case circuit breaker that is compact in size but yet capable of a broad range of current ratings. There is also a need for a molded case circuit breaker that can be easily reconfigured over a broad range of current ratings by utilizing interchangeable parts and additional parts within the tripping mechanism with a minimum of unique parts.

SUMMARY OF THE INVENTION

The circuit breaker of the present invention is a molded case circuit breaker and includes a molded case having a main cover, a first terminal and a second terminal mounted inside the case with a stationary contact electrically coupled to the first terminal and a movable contact electrically coupled to the second terminal. The movable contact is coupled to an operating mechanism which has a pivoting member moveable between an ON position, an OFF position and a TRIPPED position. An intermediate latching mechanism also is mounted in the housing and is coupled to the operating mechanism. The intermediate latching mechanism is selectively operated by a trip unit which comprises a magnetic short circuit release and a thermal overload release. The trip unit can be reconfigured by the addition of an inner yoke nested between the flanges of an outer yoke and a second magnetic shield can be attached to the outer yoke to change the sensitivity of the trip unit to the currents experienced by the circuit breaker. A particular embodiment of the circuit breaker includes an interchangeable load bus member of a copper alloy having a chemical composition of CDA #19400 and with an electrical conductivity of not more than 40% IACS.

The present invention includes a method for assembling a molded case circuit breaker which selectively includes the elements mentioned in the previous paragraph.

DETAILED DESCRIPTION OF THE PREFERRED EMBODIMENTS

Figure 1:
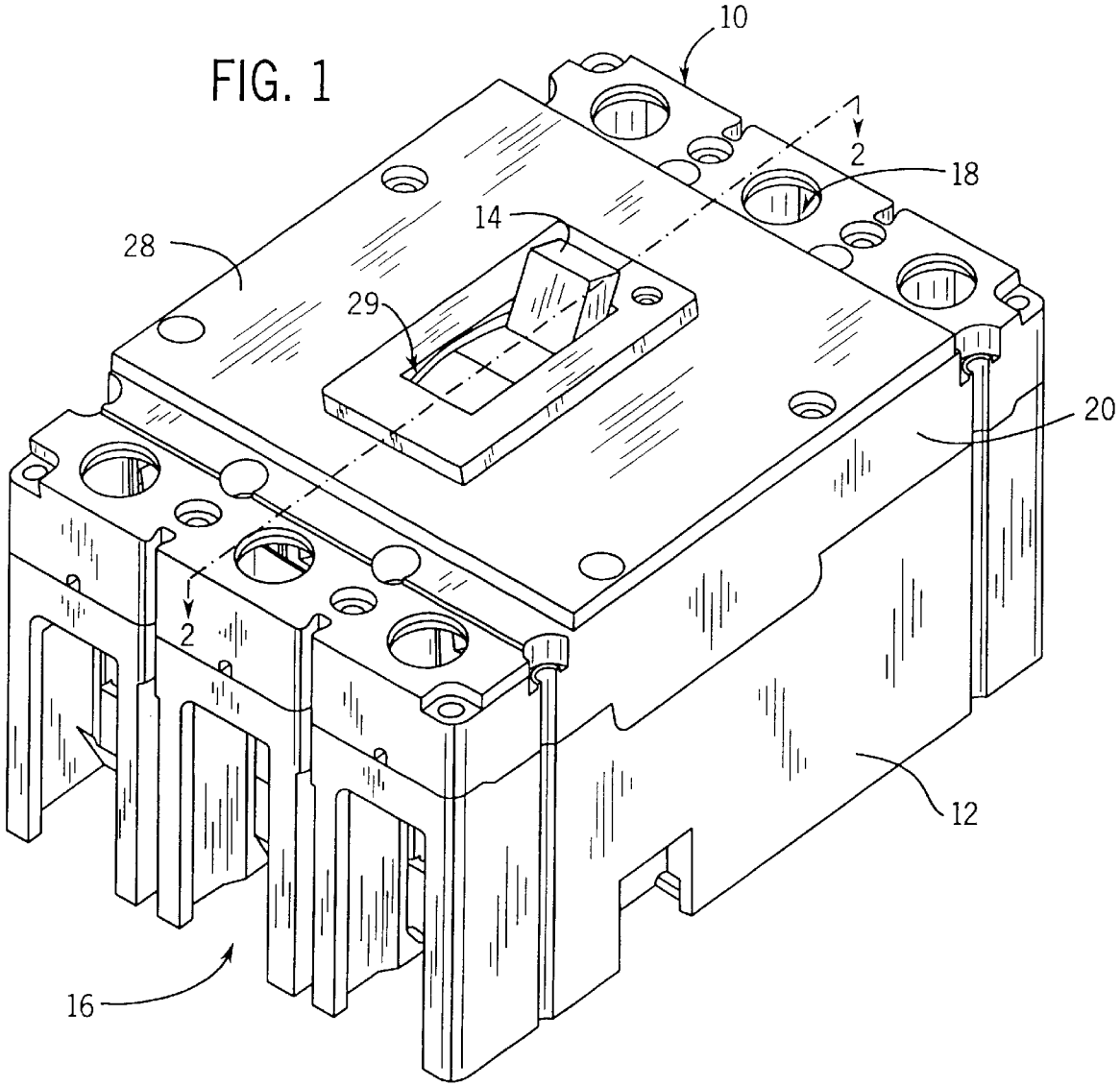
FIG. 1 is an isometric drawing of a molded case circuit breaker which includes an embodiment of the present bi-metal unit capable of broad rating applications.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
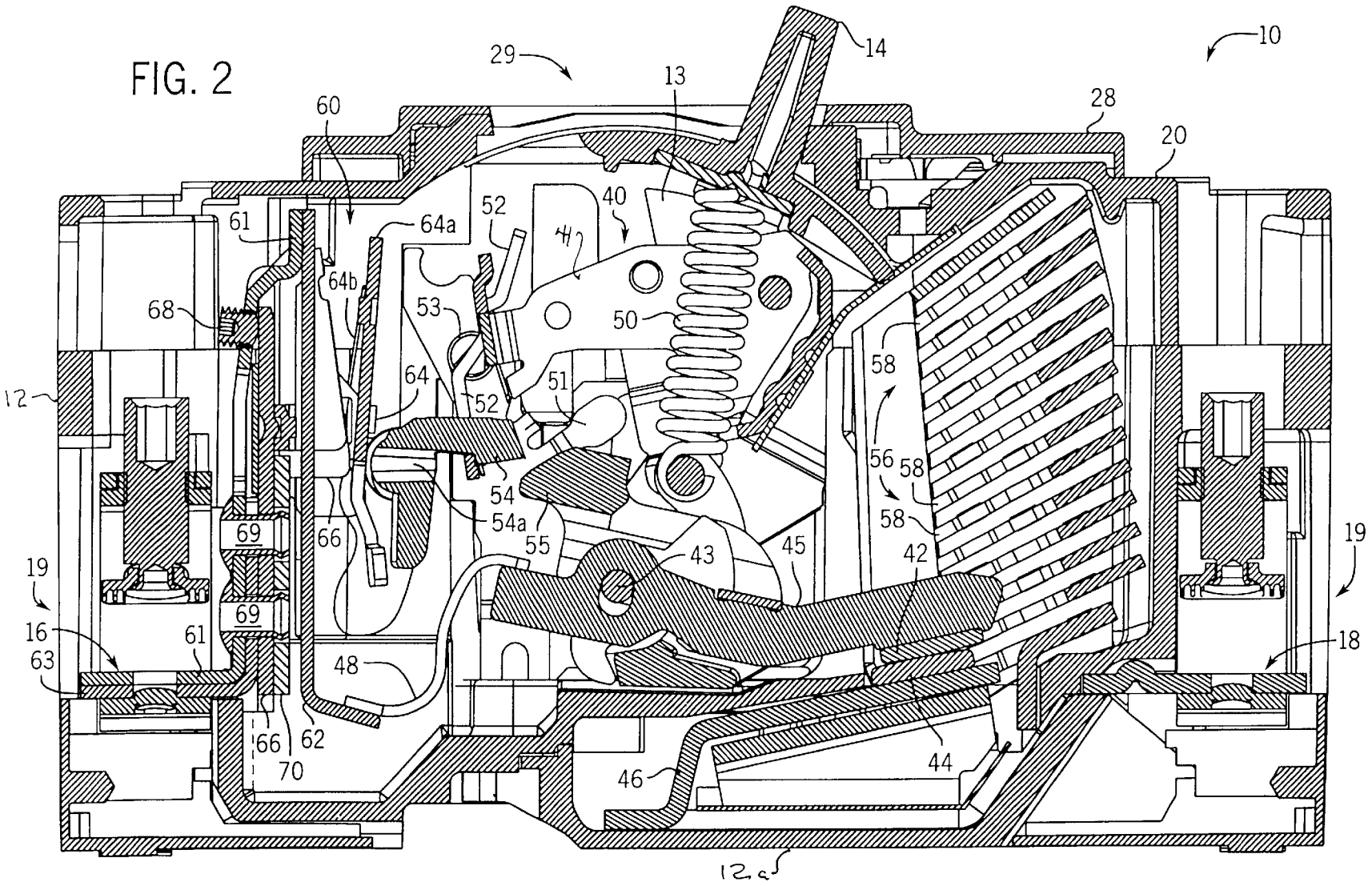
FIG. 2 is a section view of the circuit breaker shown in FIG. 1 along the lines 2—2 and is used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a sub-base 12*a*, a main circuit breaker cover 20 and an accessory cover 28, with the main breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bi-metalic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bi-metalic element 62 and from the bi-metalic element 62 to the load terminal 16. (See FIG. 3) When the current flowing through the circuit breaker exceeds the rated current for the breaker, it heats the bi-metalic element 62, causing the element 62 to bend towards the trip bar 54. If the over current condition persists, the bi-metalic element 62 bends sufficiently to engage the trip bar surface. As the bi-metalic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
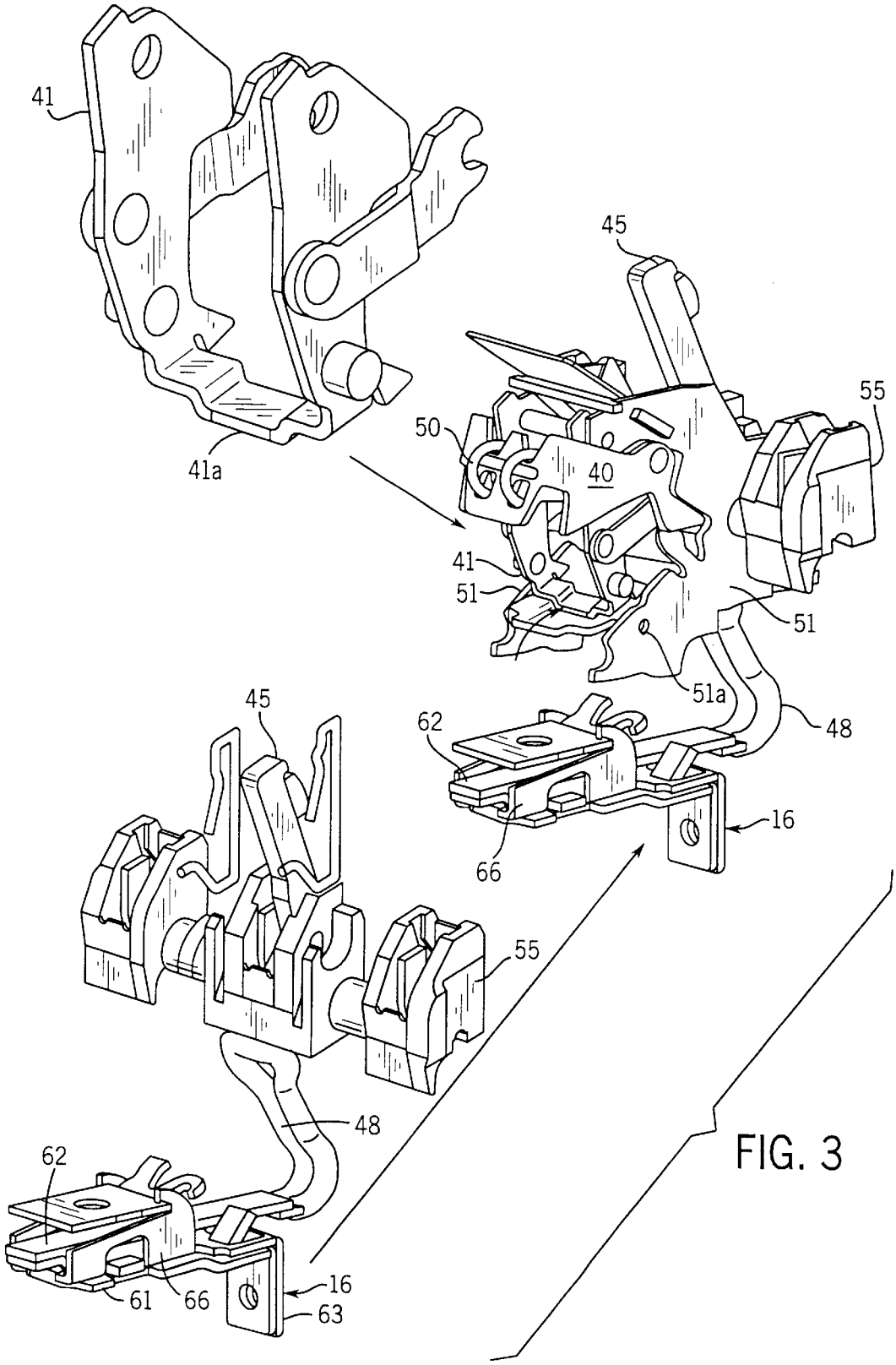
FIG. 3 is an exploded isometric drawing of the operating mechanism, contact structure and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bi-metalic element 62 by a flexible conductor 48 (e.g. braided copper strand). As shown in FIG. 3, current flows from the flexible conductor 48 through the bi-metalic element 62 to a connection at the top of the bi-metalic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

Figure 4:
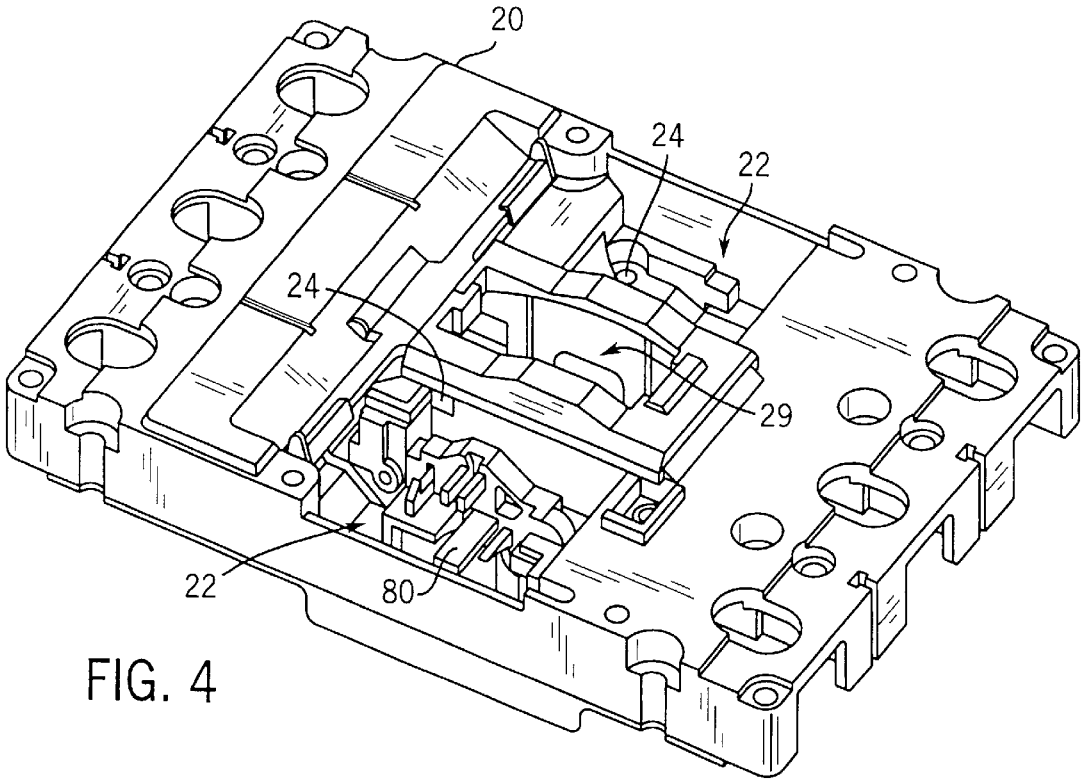
FIG. 4 is an illustration of the main circuit breaker cover for the circuit breaker shown in FIG. 1.

FIG. 4 illustrates the breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such as a shunt trip, will trip the circuit breaker 10, upon receiving a remote signal, by pushing the trip bar 54 in a counter clockwise direction causing release of the mechanism latch 52 of the operating mechanism 40. The shunt trip has a member protruding through one of the openings in the accessory socket 22 and engages the operating mechanism 40 via the trip bar 54. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

FIGS. 5–10 illustrate several embodiments of a bi-metal trip mechanism 60 and associated parts. In order to provide a broad range of current ratings, for various applications, the present bi-metal trip mechanism 60 includes several interchangeable parts. As stated above, it is desirable to time the magnetic trip mechanism 60 so that it trips at lower short circuit currents at the lower continuous current ratings, and that it trips at higher short circuit currents at the higher continuous current ratings. For example, for a circuit breaker rated at 32 amps., a magnetic trip level of 300 amps. might be desired, whereas for a breaker rated at 125 amps. of continuous current, a magnetic trip level of 2,500 amps. might be desired. In order to accommodate the various ranges of current ratings, applicants disclose a trip mechanism that can be modified with a change of certain parts, easily and advantageously during manufacture of the breaker as the needs of the circuit to be protected change from time to time.

The trip mechanism 60 comprises a magnetic short circuit release and a thermal overload release. The magnetic short circuit release is a U-shaped, yoke 66 formed from a magnetically compatible material, such as steel and magnetic shield 72. In the preferred embodiment the outer yoke 66 is integral with the magnetic shield 72. (See FIG. 8) The outer yoke 66 is connected to a magnetic armature 64*a*. A flat steel armature 64 rotates on the armature retainer 64 in response to the magnetic field generated by current flowing through the conductive path in the circuit breaker 10. The armature 64 is biased by a spring 64*b*. The outer magnetic yoke 66 is provided with spaced apart peripheral flanges 71. The outer yoke 66 is coupled to the load bus 61 and the load bus support 63 by rivets 69 or other suitable fasteners.

The bi-metal element 62 is coupled to the load bus 61 and is placed between the flanges 71 of the outer yoke 66 such that the outer yoke 66 is between the load bus 61 and the bi-metal element 62 but without the bi-metal 62 touching the outer yoke 66. A calibration screw 68 threadingly mounted in the load bus 61 changes the distance between the bi-metal element 62 and the load bus 61/outer yoke 66 combination. The calibration screw 68 changes the distant by flexing the load bus 61. The bi-metal element 62 is a planar strip having a generally rectangular cross section. One end of the bi-metal element strip is coupled to the load bus 61 with the other end of the bi-metal element 62 coupled to the moveable contact arm 45.

The coupling between the bi-metal element 62 and the moveable contact arm 45 can be by one or more flexible braids 48 or by a plug in connector or by a bolt. In the case of a coupling being the flexible braid 48, the braid is connected to the bi-metal element 62 by welding or brazing. The bi-metal element 62 is coupled to the load bus 61 also by welding or brazing. However, other suitable attachment means are contemplated herein. The trip mechanism 60 described above is mounted in the circuit breaker 10 housing 12 for each pole of the circuit breaker 10. Current flowing through the circuit breaker from the moveable contact arm 45 through the flexible braid 48 into the bi-metal element 62, than through the load bus 61 to the load terminal 16 heats the bi-metal strip 62 which causes it to deflect and engage the the trip bar 54 which in turn unlatches the intermediate latch 52 and trips the operating mechanism 40, as described above.

At normal operating currents, or at typical overload currents, other than short circuit, the outer yoke also provides a magnetic shield between the load bus 61 and the bi-metal element 62 from the repulsive magnetic field created by the current flowing in the bi-metal and load bus. For a lower continuous current rating, it is desirable to have a lower magnetic trip current. Therefore, additional magnetic shielding is appropriate and the present arrangement provides an additional inner magnetic yoke 67 which nests between the flanges 71 of the outer yoke 66. Also, since at a lower current rating, a smaller conductor can be used to carry the rated continuous current, a narrow bi-metal conductor can be used. See FIG. 6.

Figure 6:
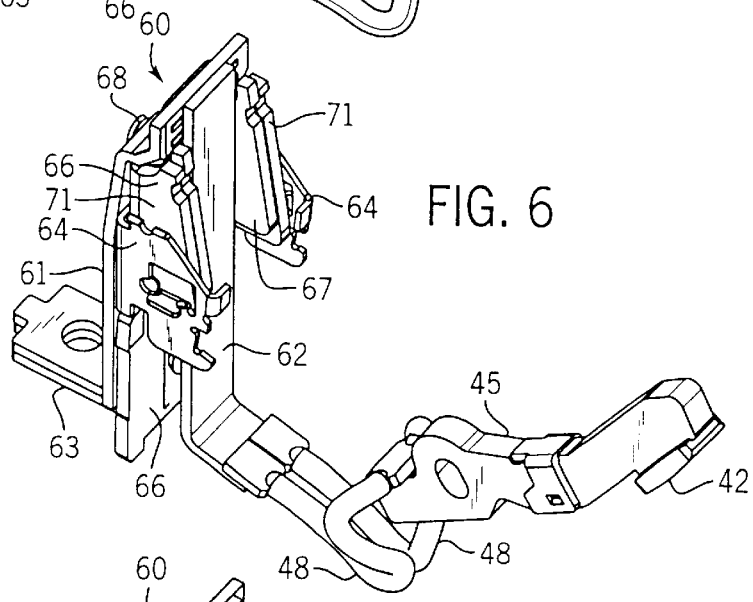
FIG. 6 is an isometric view of an embodiment of the present bi-metal trip unit with a nested inner magnetic yoke and a narrow bi-metal element coupled to a moveable load contact arm.
Figure 7:
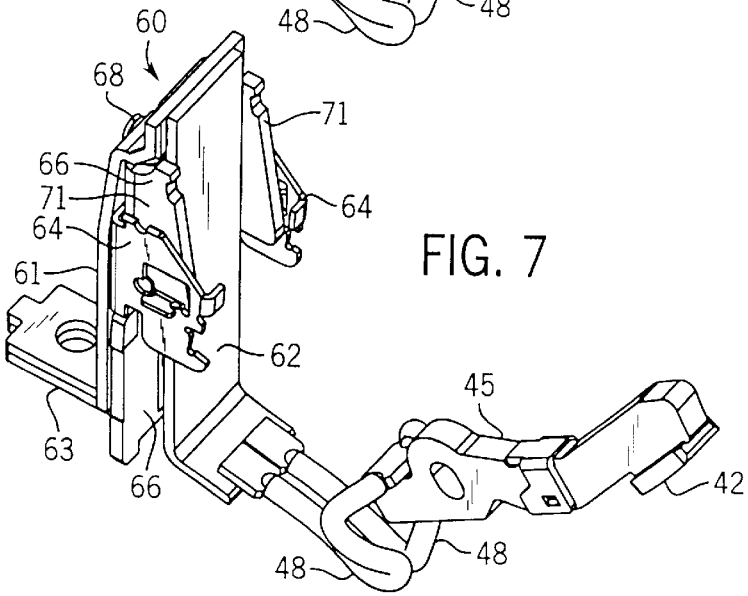
FIG. 7 is an isometric view of an embodiment of the present bi-metal trip unit with a wide bi-metal element coupled to a moveable load contact arm.
Figure 9:
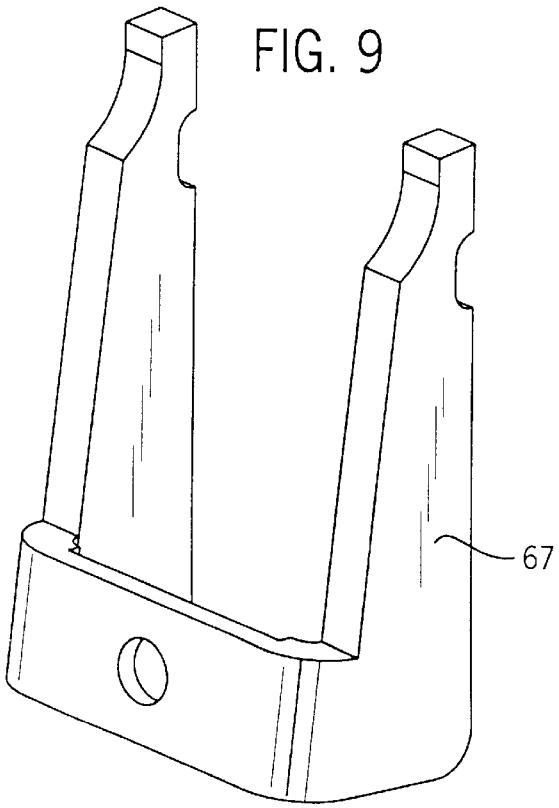
FIG. 9 is an isometric view of an embodiment of the inner magnetic yoke that nests between the flanges of the outer yoke.

The inner yoke 67 intensifies the magnetic force primarily by increasing the width of the pole faces of the electromagnet at the air gap formed between the flanges 71 of the inner and outer yokes 66, 67. The inner yoke 67 is illustrated in FIG. 9 and consists of two spaced apart parallel flanges connected by a narrow band. The inner yoke 67 is welded into the outer yoke 66 in a nested fashion as shown in FIG. 6. When the inner yoke 67 is installed in the trip mechanism 60 it does not interfere with the calibration screw 68. Such configuration optimizes the space more efficiently than if a thicker steel yoke was utilized to obtain the same magnetic shield effect. For a higher current rating, a wider bi-metal element 62 can be utilized to carry the higher current rating. See FIG. 7. In such instance, only the outer yoke 66 is necessary since the higher current and therefore the higher magnetic trip current does not require the intensified magnetic force involved at lower currents. Therefore, the thermal overload release, by utilizing an interchangeable bi-metal element 62, can operate over a broad range of current ratings with only the change or addition of a minimal number of parts thereby reducing manufacturing and maintenance costs.

To provide a circuit breaker with a bi-metal trip mechanism capable of a broad current rating applications, it is necessary to deal with a wide range of magnetic forces acting on the conductors in the circuit breaker. Because the short circuit let-through current is higher for the higher current rated breakers, such breakers experience higher magnetic forces on the conductors then do the lower rated breakers. The short circuit current magnetic forces can have an adverse affect on the subsequent performance of the circuit breaker. In a higher current rated breaker, for example 100 amps. or higher, the short circuit forces may be high enough to cause permanent deformation of the bi-metal/load terminal assembly in the trip mechanism. This deformation may change the thermal calibration characteristics of the breaker, or may interfere with resetting of the mechanism latch. On a lower current rated breaker, for example 40 amps. or below, the short circuit let-through currents and magnetic forces are lower. In such cases, deformation of the trip mechanism typically does not occur.

Figure 5:
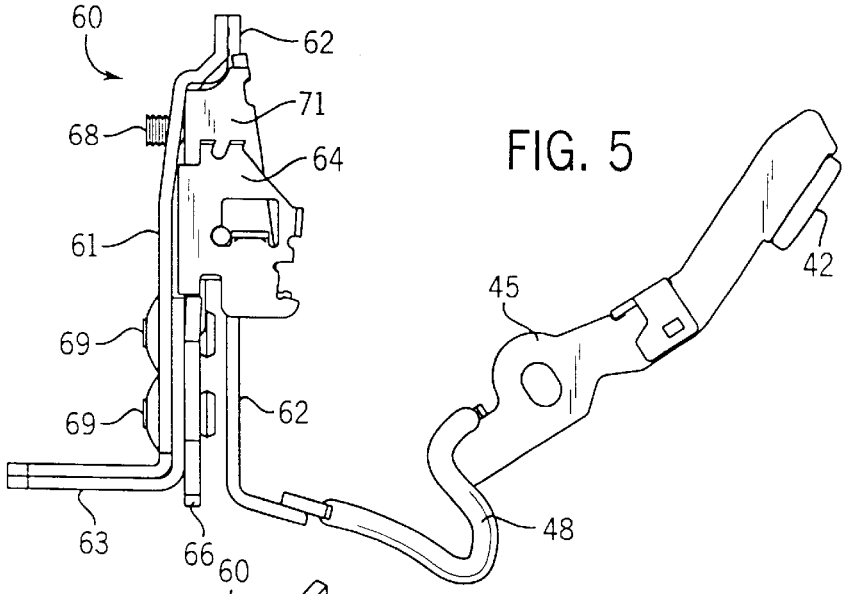
FIG. 5 is a side plan view of an embodiment of the present bi-metal trip unit coupled to a moveable load contact arm.
Figure 8:
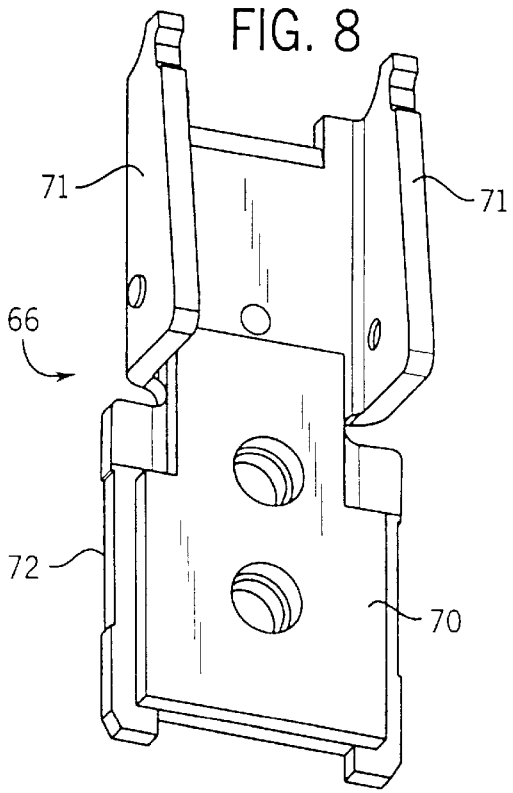
FIG. 8 is an isometric view of an embodiment of the outer magnetic yoke with a second magnetic shield attached to an integral magnetic shield portion of the outer yoke.
Figure 10:
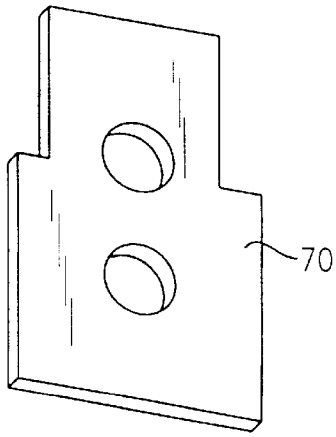
FIG. 10 is an illustration of an embodiment of a second magnetic shield that can be attached to the outer yoke.

In the present bi-metal trip mechanism 60 the assembly of the load bus 61 and bi-metal element 62, as shown in FIG. 5 can be used for a low current ratings, i.e., below 40 amps. The magnetic shield 72 is integral with the outer magnetic yoke 66 and is interposed between the load bus 61 and the bi-metal element 62. The two facilitate the necessary magnetic force to trip the breaker in the event of a short circuit condition, with an additional inner magnetic yoke 67 added to the assembly as show in FIG. 6. However, on the higher current rated breakers, i.e., 100 amps. or above, the outer magnetic yoke 66 with the integral magnetic shield 72 may not provide enough shielding to prevent the bi-metal/load terminal assembly from deforming. To provide additional magnetic shielding, a second magnetic shield 70 as shown in FIGS. 8 and 10 can be added to the outer yoke 66.

FIG. 2 illustrates the bi-metal trip assembly 60 with the additional magnetic shield 70 installed and held in place by the rivets 69. The additional magnetic shield 70 may also be attached to the outer magnetic yoke by welding or other suitable attachment means. This method of providing additional magnetic shielding avoids the requirement of having two separate outer magnetic yokes for the various current ratings of the circuit breakers. A single outer magnetic yoke 66 can be used in a broad range of current ratings by adding such parts as the inner yoke 67 to amplify magnetic forces as necessary or to add the second magnetic shield 70 to protect from bi-metal deformation during high current conditions in the higher current rated circuit breaker.

Another method of addressing the deformation problem experienced by the load bus 61/bi-metal element 62 assembly is to increase the strength of the load bus 61. The Applicants have determined that deformation of the load bus 61 occurs during a short circuit current condition from the magnetic repulsion forces created in the bi-metal element 62 and the load bus 61 principally in the zone of material located on the load bus 61 near the bi-metal 62/load bus 61 connection which typically is a brazed joint. This area of the bi-metal trip mechanism is susceptible to the deformation because the brazing operation anneals the load bus material which weakens the load bus in that localized area.

Generally available copper alloys, for example Copper Development Association (CDA) alloy #19400 is resistant to losing strength during the the brazing operation. However, since the load bus 61 contributes heat as part of the thermal overload release system, the electrical conductivity of material must be considered in selecting an appropriate load bus material. Various materials having different electrical conducting characteristics are used in forming the interchangeable load bus member 61 of the trip unit 60. Normally available CDA #19400 copper alloy has a typical electrical conductivity of 65% International Annealed Copper Standard (IACS)(0.377 megmho-cm). Applicants, have determined that standard CDA #19400 may not provide a sufficient resistance heating in a bi-metal trip unit where a lower conductivity is preferred. However, they have also determined that by careful metallurgical processing, the copper alloy with a chemical composition of a CDA #19400 but with a reduced electrical conductivity of not more than 40% IACS is possible. Such an alloy retains the mechanical strength of CDA #19400 and also has the ability to retain strength after a brazing operation and can still be used in a lower current rating circuit breaker requiring a thermal overload release at a lower let-through current. Applicants have utilized the reduced conductivity CDA #19400 copper alloy in the circuit breaker 10 with a current rating as low as 80 amps.

While the embodiments illustrated in the Figures and described above are presently preferred, it should be understood that these embodiments are offered by way of example only. The invention is not intended to be limited to any particular embodiment, but is intended to extend to various modifications that nevertheless fall within the scope of the appended claims. For example, other types of copper alloys can be utilized with the load bus and different cross sectional shapes can be utilized for the bi-metal elements as well as utilizing multiple bi-metal elements maintained within the outer yoke assembly. It is also contemplated that the trip mechanism with the bi-metal trip unit and load terminal be housed in a separate housing capable of mechanically and electrically connecting to a housing containing the operating mechanism and line terminal thereby providing for a quick and easy change of current ratings for an application of the circuit breaker contemplated herein. Other modifications will be evident to those with ordinary skill in the art.

What is claimed is:

1. A method for reconfiguring a molded case circuit breaker over a broad range of current ratings by utilizing interchangeable members, with the circuit braker having a molded housing with removable cover, an operating mechanism having a movable contact in the housing and coupled to a line terminal and an intermediate latching mechanism, and a load terminal including a load bus member mounted in the housing, with the load terminal coupled to the movable contact member, the method comprising the steps of:

installing a trip unit in the housing; with the trip unit having a magnetic short circuit release and a thermal overload release with interchangeable bi-metal members; and coupling the trip unit to the moveable contact and load terminal with the trip unit in selective operative contact with the intermediate latching mechanism.

2. The method of claim 1, including the step of nesting an inner yoke between spaced apart perpheral flanges of an outer yoke in the magnetic short circuit release.

3. The method of claim 1, including the step of attaching an additional magnetic shield to an integral shield of the outer yoke in the magnetic short circuit release.

4. The method of claim 1, including the step of installing an interchangeable bi-metal member in the thermal overload release selected from a group consisting of a wide bi-metal conductor and a narrow bi-metal conductor.

5. The method of claim 1, wherein the load bus member is a copper alloy having a chemical composition of CDA #19400 with an electrical conductivity of not more than 40% IACS.

6. A circuit breaker comprising:

a housing including a base;

a means for connecting a load to the breaker, mounted in the housing:

a means for connecting an electrical line to the breaker, mounted in the housing;

a stationary contact electrically coupled to the means for connecting an electrical line;

a moveable contact coupled to a means for operating mounted in the housing and having a pivoting member moveable between an ON position and OFF position, and a TRIPPED position, with the pivoting member coupled to the moveable contact and with the means for operating coupled to an intermediate means for latching the means for operating; and a means for tripping coupled to the moveable contact and the means for connecting a load with the means for tripping in selective operative contact with the intermediate means for latching;

wherein the means for tripping includes a means for releasing under a short circuit condition and a means for releasing under an overload condition, wherein the means for releasing under a short circuit condition comprises an outer yoke with a magnetic shield and the means for releasing under an overload condition includes an interchangeable bi-metal member.

7. The circuit breaker of claim 6, wherein the outer yoke is provided with spaced apart peripheral flanges and including an inner yoke nested between the flanges of the outer yoke.

8. The circuit breaker of claim 6, including a second magnetic shield attached to the outer yoke.

9. The circuit breaker of claim 6, wherein the interchangeable bi-metal member is selected from a group consisting of a wide bi-metal conductor and a narrow bi-metal conductor.

* * * * *